United States Patent [19]

Connor

[11] 4,437,842

[45] Mar. 20, 1984

[54] SURFING DEVICE

[76] Inventor: Terrence E. Connor, 8146-D Imperial Ave., Lemon Grove, Calif. 92045

[21] Appl. No.: 354,155

[22] Filed: Mar. 5, 1982

[51] Int. Cl.[3] ..... A63C 15/00

[52] U.S. Cl. ..... 441/65; 441/74

[58] Field of Search ..... 441/65, 55–58, 441/66, 67, 68, 74; 272/1 B; D21/228, 236, 237

[56] References Cited

U.S. PATENT DOCUMENTS 2,211,536 8/1940 Clayton, Jr. ..... 441/57

4,028,761 6/1977 Taylor ..... 441/65

FOREIGN PATENT DOCUMENTS

D 17827 8/1956 Fed. Rep. of Germany .

*Primary Examiner*—Sherman D. Basinger

*Attorney, Agent, or Firm*—LeBlanc, Nolan, Shur & Nies

[57] ABSTRACT

A bodysurfing device which assists in providing buoyancy as well as increased speed through the water. The device includes an elongated planar buoyant member with a compartment of streamlined shape located at the forward end of the buoyant member, having an opening therein to receive the hand of the surfer. A series of ridges and recessed portions in the surface of the planar member allow the surfer to firmly grip the device. By inserting one hand in the compartment and extending the arm bearing the device in front of him, the surfer can greatly increase his speed through the water while riding a wave.

6 Claims, 5 Drawing Figures

FIG. 1
PRIOR ART
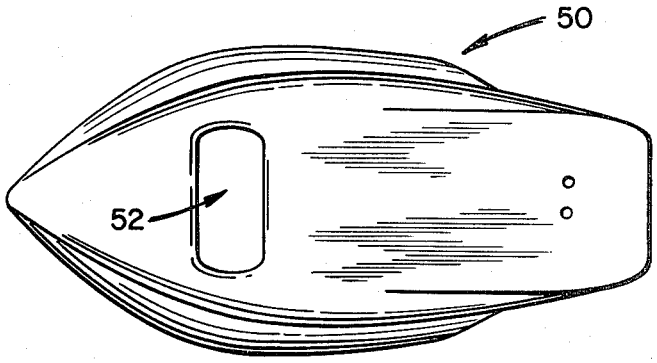
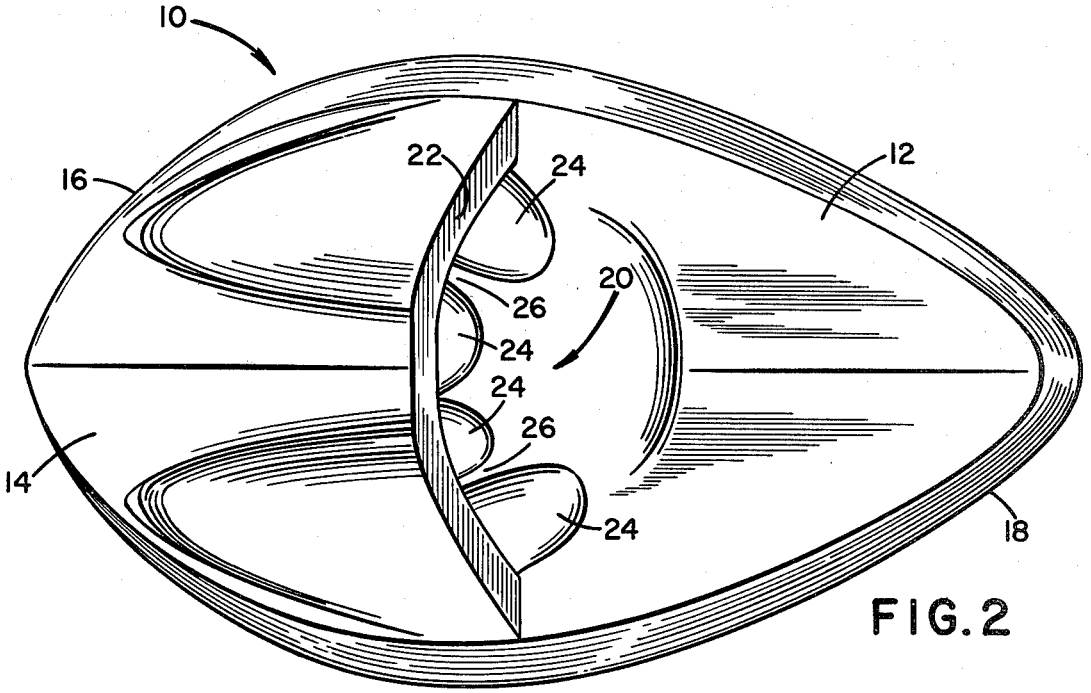
FIG. 2
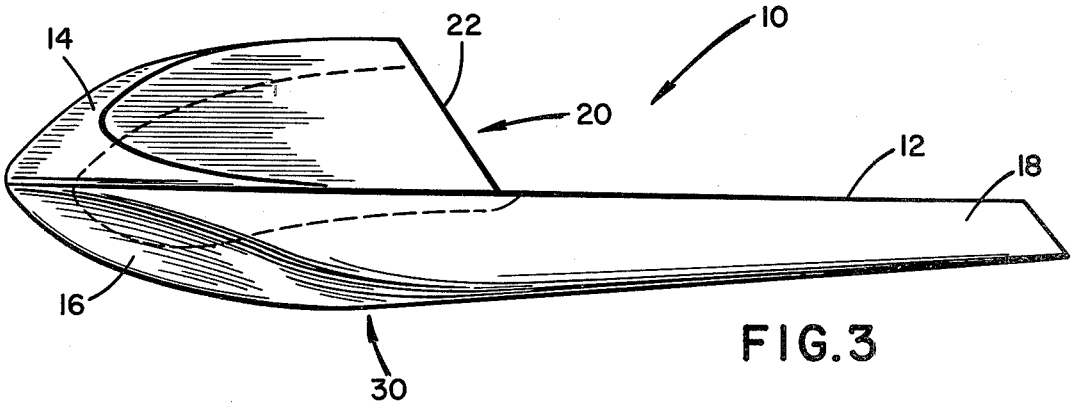
FIG. 3

FIG. 5
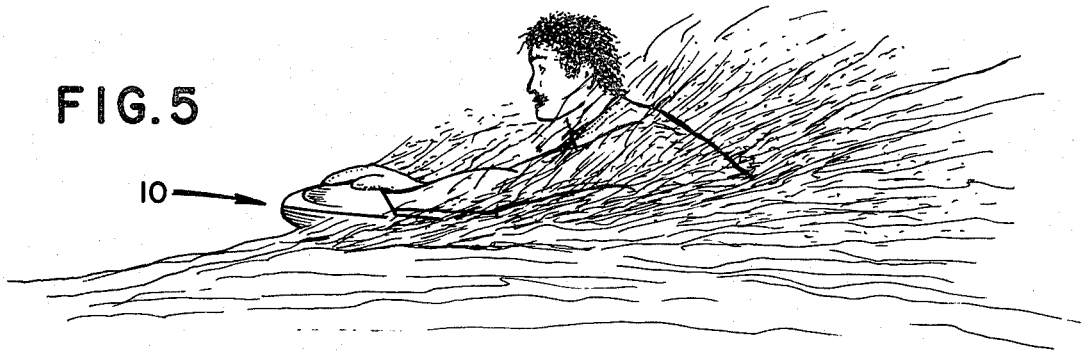
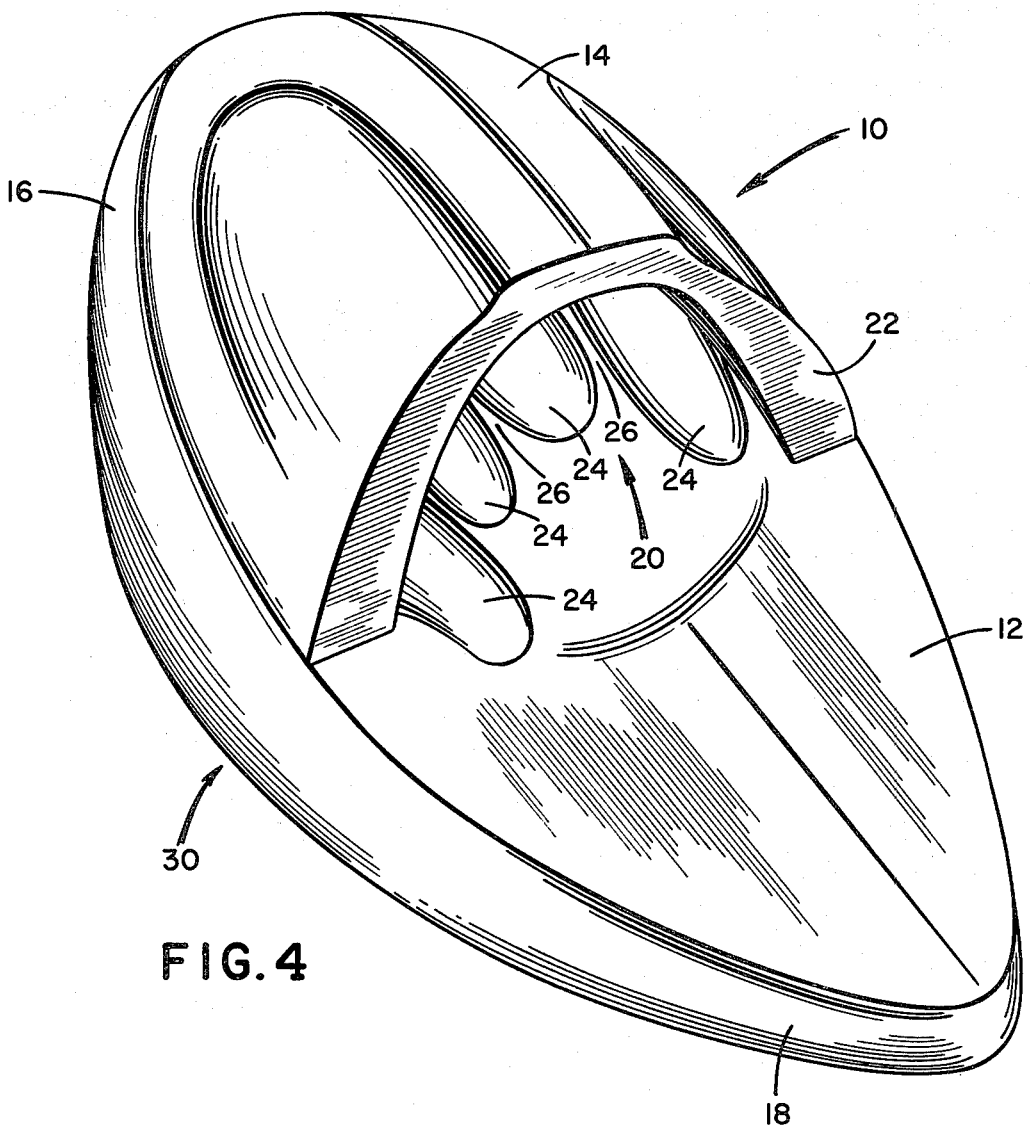
FIG. 4

SURFING DEVICE

BACKGROUND OF THE INVENTION

The present invention relates to a surfing device. More particularly, the invention relates to a device for use in the sport of bodysurfing, said device having a compartment which fits the hand of the user and being of a size, shape and material which provide an excellent surface with which to hydroplane the water.

The sport of bodysurfing has increased greatly in popularity in recent years. In practicing this sport, the surfer allows his body to be propelled through the water by the action of the waves in the vicinity of the ocean beach. Usually the surfer adopts a prone position so as to ride the waves with his arms out stretched in front of him.

Various prior art devices have been employed by body surfers to provide increased buoyancy and otherwise assist in travelling through the water. Such prior art devices have suffered from various deficiencies, including insufficient buoyancy and improper size for use by surfers of various age groups, i.e., children as well as adults.

SUMMARY OF THE INVENTION

Accordingly, it is an object of the present invention to provide a bodysurfing device having buoyancy features which provide support while the surfer is treading water or waiting for a wave, as well as while being propelled by the wave.

It is a further object of the invention to provide a bodysurfing device of a size and shape which do not hinder the surfer in getting out through the surf to catch a wave, while also being of a streamlined shape which assists the surfer in travelling through the water while riding the wave.

It is an additional object of the invention to provide a device which is constructed of a relatively resilient material so that it is not dangerous to use during rough wave conditions.

Another object of the invention is to provide a device which may be easily transported to and from the beach for use in bodysurfing.

By the present invention there is provided an improved bodysurfing device, including an elongated buoyant planar member, of a generally tear drop shape, with a compartment of streamlined shape located at the upper forward end thereof for receiving the hand of the surfer. A series of ridges and recessed portions in the planar member assist in gripping the device. The device is preferably constructed as an integral, one-piece unit, of a resilient foam material.

BRIEF DESCRIPTION OF THE DRAWINGS

The foregoing and other objects and advantages of the present invention will become apparent from the appended claims and from the following detailed description and discussion of the invention taken in conjunction with the accompanying drawings, wherein:

FIG. 1 is a top plan view of a prior art surfing device;

FIG. 2 is a top plan view of the bodysurfing device of the present invention;

FIG. 3 is a side elevation of the surfing device of FIG. 2;

FIG. 4 is a perspective view of the surfing device of FIG. 2; and

FIG. 5 is a schematic drawing showing a surfer using the bodysurfing device of the present invention.

DESCRIPTION OF THE PREFERRED EMBODIMENTS

In the embodiment of the present invention as shown in FIGS. 2–4, there is provided a bodysurfing device 10, including an elongated, generally planar, buoyant member 12 having a compartment 14 attached to the upper surface of the forward end 16 thereof. The planar member 12 has the general shape of a tear drop, as viewed from above, with the widest portion of the member 12 at approximately the midpoint of its length, and with the sides curving inwardly to form the forward 16 and aft 18 end portions, with the aft end portion 18 being of relatively narrow width compared to the forward end portion 16, thus providing a streamlined surface which is advantageous in riding the waves.

The walls of compartment 14 extend upwardly and rearwardly from the forward end portion 16 of the member 12, defining a generally arched surface which extends to approximately the mid point of the length of member 12. A cavity 20 is formed in the compartment 14 at the rear end 22 thereof, the cavity 20 being of a size and shape to receive the hand of the surfer.

In a preferred embodiment, the planar member 12 and compartment 14 are formed as an integral one-piece or monolithic structure of a resilient foam material such as soft-skin type polyurethane foam, by methods well known in the field of the invention. As an example of the dimensions of the device 10, one embodiment of the present surfing device 10 has an overall length of approximately 18 inches, a width of approximately 11 inches at the widest point and a height at the extreme upper end of the compartment 14 of approximately 5 inches.

Adjacent the interior of the compartment 14, the upper surface of member 12 is molded so as to provide a series of recesses 24 which will allow the hand of the surfer to be placed in a flat condition within the compartment 14 and with raised portions or ridges 26 between the recesses 24 which will allow the hand to easily grip the surface of planar member 12.

The bodysurfing device 10 of the present invention, which I chose to call the "SKOOTER", is distinguished from prior art surfing devices such as shown in FIG. 1. The surfing device 50 of FIG. 1, known as the "HAND GUN" has several deficiencies, including the fact that water shoots up through the opening 52 located in the center portion of the device, said opening 52 being for the purpose of providing a grip. Such water splashes upwardly and interferes with the performance characteristics of the device and is also a source of annoyance to the user. Other adverse features of the prior art device 50 of FIG. 1 include the fact it is made of a hard dense foam material which can be dangerous in rough surf conditions, and that the device provides insufficient buoyancy to provide the support necessary while treading water or swimming. Also, the size of the device 50 is too small to be used by children, as it does not provide a sufficient buoyant effect to support them in the water.

In the use of the device 10 of the present invention, the body surfer places his hand inside the cavity 20 within compartment 14 of the device 10, gripping the ridges 26 and the surfaces of recesses 24, and extends his arm bearing the device 10 out in front of himself as he enters the wave, as shown in FIG. 5. The other hand of the surfer can be placed on top of the device 10 or left at the bodysurfer's side. The lower surface 30 of member 12 is generally flat, curving upward toward the front, and thus acts as a hydroplaning surface. By the use of the present invention the bodysurfer can greatly increase his speed through the water, thus making bodysurfing a totally unique experience.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What I claim and desire to have secured by Letters Patent of the United States is:

1. A device for facilitating an enhancing bodysurfing, adapted to receive a hand of the surfer, and selectedly supporting one or both hands of the surfer so that the upper arms and head of the surfer are raised somewhat during surfing, whereby increased speed and buoyancy through the water are provided, the device comprising:

an elongated, buoyant planar member having its widest portion at approximately the midpoint of the length thereof and with the sides of the member curving inwardly toward the front and rear to provide a streamlined configuration;

a compartment located at the upper forward end of said planar member, the major portion of said compartment being located forwardly of a transverse horizontal midline of said planar member, said compartment having an opening in the rear thereof to receive the hand of the surfer with the heel of the palm of the surfer being located upon said planar member at approximately said transverse midline thereof, that portion of the upper surface of the planar member adjacent said compartment opening thus defining a support surface for the heel of the palm of the surfer, there being a substantial portion of said planar member trailing rearwardly of said support surface; and a top on said compartment extending upwardly and rearwardly from the forward end portion of the planar member, to define a streamlined, generally arched outer surface extending approximately to and above said planar transverse midline, thus to form an additional, second support surface for the other hand of the surfer;

whereby said planar member support surface is employed by one hand of the surfer during surfing to raise somewhat the upper arms and head of the surfer, thus to increase buoyancy and speed through the water, the other hand of the surfer being selectively placed upon said compartment top or trailing alongside the body of the surfer.

2. The surfing device of claim 1 wherein the planar member is of a generally tear drop shape, with the aft end portion being of relatively narrow width compared to the forward end portion.

3. The surfing device of claim 1 wherein a series of ridges and recessed portions are provided in the upper surface of the planar member adjacent the compartment.

4. The surface device of claim 1 wherein the planar member and the compartment are formed as an integral one-piece structure of a resilient foam material.

5. The surfing device of claim 4 wherein said foam material is a soft-skin type polyurethane foam.

6. The surfing device of claim 1 wherein the lower surface of the planar member is generally flat, curving upward toward the front to act as a hydroplaning surface.

* * * * *

UNITED STATES PATENT AND TRADEMARK OFFICE

CERTIFICATE OF CORRECTION

PATENT NO. : 4,437,842

DATED : March 20, 1984

INVENTOR(S) : Terrence Connor

It is certified that error appears in the above-identified patent and that said Letters Patent is hereby corrected as shown below:

Claim 1, line 1, "an" should read -- and --.

Signed and Sealed this

*Fourth* Day of *June 1985*

[SEAL]

*Attest:*

DONALD J. QUIGG

*Attesting Officer*

*Acting Commissioner of Patents and Trademarks*